US008566963B2

(12) United States Patent
Ryan

(10) Patent No.: US 8,566,963 B2
(45) Date of Patent: Oct. 29, 2013

(54) CONCEALED INTERIOR POUCH POCKET

(76) Inventor: Isabelle Ryan, Unalakleet, AK (US)

( * ) Notice: Subject to any disclaimer, the term of this patent is extended or adjusted under 35 U.S.C. 154(b) by 0 days.

(21) Appl. No.: 13/365,669

(22) Filed: Feb. 3, 2012

(65) Prior Publication Data

US 2013/0000010 A1 Jan. 3, 2013

Related U.S. Application Data

(60) Provisional application No. 61/503,212, filed on Jun. 30, 2011.

(51) Int. Cl.
*A41D 3/02* (2006.01)

(52) U.S. Cl.
USPC ..... 2/84; 2/252; 2/253

(58) Field of Classification Search
USPC ..... 2/93, 94, 84, 252, 253, 247, 69, 128
See application file for complete search history.

(56) References Cited

U.S. PATENT DOCUMENTS 1,360,395 A * 11/1920 Hasprunar ..... 2/253
2,224,734 A * 12/1940 Kopf ..... 2/253
2,324,722 A * 7/1943 Papierniak ..... 2/93
2,368,654 A * 2/1945 Frank ..... 2/94
D161,540 S * 1/1951 Russfield ..... D2/836
2,593,795 A * 4/1952 Rhoads et al. ..... 2/235
2,607,040 A * 8/1952 Zaleski ..... 2/51
2,846,685 A * 8/1958 Ehrich ..... 2/51
2,882,532 A * 4/1959 O'Donnell ..... 2/253
2,967,307 A * 1/1961 O'Donnell ..... 2/253
3,772,708 A * 11/1973 Segelin ..... 2/253
4,062,064 A * 12/1977 Vosatka ..... 2/252
4,404,687 A * 9/1983 Hager ..... 2/94
4,553,269 A 11/1985 Nowak
4,791,681 A * 12/1988 Dean ..... 2/106
4,860,388 A * 8/1989 Dean ..... 2/247
5,165,115 A 11/1992 Stanislaw
5,509,147 A * 4/1996 Busquets ..... 2/253
6,131,198 A * 10/2000 Westrick ..... 2/102
6,175,966 B1 1/2001 Wiesenthal
7,143,450 B2 * 12/2006 Green, III ..... 2/94
7,197,772 B2 * 4/2007 Crye et al. ..... 2/247
D570,577 S * 6/2008 Keppler ..... D2/750
7,620,998 B2 * 11/2009 Sandoval ..... 2/69
D608,983 S * 2/2010 Myers ..... D2/857
7,908,675 B2 * 3/2011 Robinson ..... 2/247
8,234,720 B2 * 8/2012 Freedman et al. ..... 2/128
8,312,568 B2 * 11/2012 Marois et al. ..... 2/252
2004/0133966 A1 * 7/2004 Ebihara ..... 2/247
2005/0246823 A1 * 11/2005 Groom ..... 2/247
2008/0196140 A1 * 8/2008 Mayerson et al. ..... 2/84
2009/0031468 A1 * 2/2009 Sandoval ..... 2/69
2009/0158493 A1 * 6/2009 Kim ..... 2/93
2011/0185471 A1 * 8/2011 Buczkowski et al. ..... 2/84
2012/0005802 A1 * 1/2012 Claeys ..... 2/84

* cited by examiner

*Primary Examiner* — Richale Quinn
(74) *Attorney, Agent, or Firm* — Daniel Boudwin

(57) ABSTRACT

An outerwear garment that incorporates a sealable, concealed pocket sewn inside of the pouch pocket of an outer garment that features such a pouch pocket. The device consists of an outerwear garment that has a pouch pocket located at the front, center of the garment on the lower portion of the garment. The concealed pocket is sewn into the garment, inside the pouch pocket, and incorporates a concealed pocket sealing mechanism for closure. The concealed pocket located inside the pouch pocket allows an individual to store his or her personal items in a secure location while still retaining the pouch pocket for the purpose of providing the individual with a place to easily insert his or her hands or other items of lesser importance. The design of the exterior pouch pocket conceals bulky items stored within the concealed interior pocket from detection by an onlooker.

4 Claims, 3 Drawing Sheets

CONCEALED INTERIOR POUCH POCKET

CROSS REFERENCE TO RELATED APPLICATION

This application claims the benefit of U.S. Provisional Application No. 61/503,212 filed on Jun. 30, 2011, entitled "Secret pocket."

BACKGROUND OF THE INVENTION

1. Field of the Invention

The present invention relates to a concealed storage pocket that is incorporated into the pouch pocket of an outerwear garment. More specifically, the present invention provides an interior pocket within a larger pouch that utilizes a closure means to ensure that items stored inside the concealed pocket remain securely inside. The primary purpose of concealment is to minimize attention of pick-pockets or thieves from items stored within this secured and interior pocket.

2. Description of the Prior Art

In an effort to keep warm in colder climates, many individuals wear several layers of clothing. While jackets are a very popular form of outerwear, sometimes a jacket is too formal, too long or too cumbersome due to its style or design. Many individuals prefer to wear more comfortable outer garments such as fleece pullovers or hooded sweatshirts. These types of garments are preferred because they are typically warm, slightly oversized by design and comfortable to wear. These types of outer garments also normally feature a large, exterior pouch pocket on the front of the garment. The purpose of the pouch pocket is to carry personal items as well as to serve as a place to keep the wearer's hands warm. The pouch pocket often has large openings on either side to allow for the wearer to insert personal items as well as a user's hands. While the large openings allow for easy insertion of the aforementioned items into the pouch pocket, the large openings also allow for items to easily fall out of the pocket accidentally or be easily visualized and removed therefrom.

In some situations, items may fall out of the pocket without the knowledge of the individual wearer of the garment. This is problematic as the personal items can become lost. Another concern is that the large openings make it very easy for a thief to pick-pocket from the pouch on this type of outer garment. This is particularly a problem for women who wear this type of outer garment and utilize the pouch pocket as a purse substitute; carrying her wallet, keys, money, etc., in the pouch pocket. The theft problem is not limited to women, however. Men also have a propensity to store wallets, keys and money in the pouch pocket on these types of garments. While the pouch pocket offers an individual a large storage space for personal items, the pouch pocket offers little protection or security for those personal items once placed in the pocket.

Several patents attempt to addresses such concerns regarding pockets. For example, U.S. Pat. No. 3,772,708 to Segelin describes a concealable pocket structure that incorporates into a garment pocket, which results in two pockets existing in the same location on a garment—an actual pocket and a concealed pocket. The structure of the Segelin pocket has three panels: a back panel that secures to the garment, an intermediate panel that divides the pocket into the actual pocket and the concealed pocket and a front panel that is spaced away from the garment that has a flap attached to the portion of the front panel, which folds over the intermediate panel to form the concealed pocket. The individual wearer of the pocket would place their valuable items in the concealed pocket by lifting the folded panel back and inserting his or her items into the concealed pocket. The individual would then replace the folded panel, leaving only the actual pocket easily accessible. If a thief were to access the pocket, the thief would only find the actual portion of the pocket and would find the pocket to be empty as the individual with the pocket has hidden his or her personal items in the concealed pocket.

Similar to the pocket structure described in the Segelin patent is U.S. Pat. No. 4,553,269 to Nowak that describes a concealable pocket structure that incorporates into a garment pocket, which results in two pockets existing in the same location on a garment—an actual pocket and a concealed pocket, with an intermediate space in between for additional layer of security. The structure of the Nowak pocket has four panels. First, there is a front panel that is spaced away from the garment and forms the front of the actual pocket. Next, there is a first intermediate panel that forms the backside of the actual pocket. Inconspicuously, the first intermediate panel extends up behind the pocket opening. An intermediate space exists between the first intermediate panel and a second intermediate panel. The concealed pocket lies under the second intermediate panel, whereby the second intermediate panel forms the front side of the concealed pocket. A back panel forms the backside of the concealed pocket and attaches to the garment.

To access the concealed pocket of the device, an individual must access the actual pocket and pull back the first intermediate panel from the top of the first panel. Pulling back the first panel grants access to the intermediate space between the first intermediate panel and the second intermediate panel. An individual reaches down through the intermediate space to gain access to the concealed pocket by pulling up on the second intermediate panel from the bottom of the second intermediate panel. An individual places his or her valuable personal items in the concealed pocket and then replaces the intermediate panels such that the concealed pocket is undetectable.

The Nowak pocket structure offers a high level of security when concealing personal items. The purpose of the Nowak pocket structure is to conceal a personal item in a pocket such that no one would know the item is in the pocket. Thus, to remain undetected, an individual should limit the size of the items he or she stores in the concealed pocket. Not only that, the process of accessing the concealed Nowak pocket requires such effort that it would be virtually impossible for a thief to access the concealed pocket without detection. Yet, the same aspect of the device that makes it useful—the highly involved process in accessing the concealed pocket—can also be an undesirable characteristic of the device for many individuals. The present invention provides an individual with a secure, concealed pocket to store personal items in that is not overly complicated to access, and allows for a large volume of storage compared to the Nowak pocket structure. The pouch design of the outer pocket described by the present invention effectively hides lumps or bumps in the garment attributable to items stored in the concealed pocket. The present invention conceals the concealed pocket inside the pouch pocket and utilizes a zipper to ensure that those items stay within the pocket and do not accidentally fall out. The zipper also adds a level security against theft as a thief would likely be detected during the unzipping of the concealed pocket.

U.S. Pat. No. 5,509,147 to Buquets describes plurality of pockets for a garment that incorporates a hidden concealed pocket. For example, one embodiment of the Buquets pocket structure is a breast pocket with two pockets in place of the traditional single breast pocket on a shirt or jacket garment. The pair of pockets form a flap that is sewn to the garment at the top of the pocket and attaches by hook and eye fasteners at the bottom of the pocket so that the pair of breast pockets, which forms the flap, pulls away from the garment at the bottom of the flap to reveal a concealed zipper pocket. The purpose of the Buquets pocket system is to provide an individual with a plurality of pocket options on a single garment with some pockets overlapping others. Inconspicuous concealment of pockets is not the intent. Regardless, the limitation of the Buquets device is the volume of items which can feasibly be stored in the concealed pocket. Bulky items such as a wallet, keys or cellular phone could be placed in the concealed pocket; however, it would be outwardly apparent that a bulky item is being concealed in the hidden pocket. Furthermore, some individuals do not desire to have a concealed breast pocket, and would prefer the comfort and style associated with hooded sweatshirts or pullovers. The present invention is a pocket structure for incorporation into such outer garments. The bulky nature of personal items stored inside the concealed pocket need not be considered as the design of the exterior pouch pocket, within which the concealed pocket is concealed, hides the bulky shape of the stored items.

U.S. Pat. No. 5,165,115 to Stanislaw describes an inconspicuous concealed pocket incorporated into the lining of a garment, particularly garments including swimsuits, beach wear, active and exercise wear. Such garments are typically tight fitting or snug by design, and feature no pockets as pockets filled with personal items would distort the look of the clothing. The Stanislaw pocket structure is intended to be a slim pocket, for the storage of thin items such as personal identification cards, gym access cards, beach access cards or a thin money clip. The top of the pocket is capable of closure as the closure mechanism is incorporated into some decorative seam or aspect of the garment such that the closure mechanism is undetectable.

The Stanislaw pocket structure is limited in the types of personal items that can be stored within. Thin, flat items are the intended items to be stored inconspicuously as a bulky item is outwardly detectable due to the nature of the garment. Storing keys in a concealed bathing suit pocket stretches the bathing suit material and distorts the look of the bathing suit, making it outwardly apparent that the wearer is storing some concealed item of odd shape in his or her swim wear. The present invention is a pocket structure for incorporation into outer garments, such as hooded sweaters or fleece pullovers. The bulky nature of personal items stored inside the concealed pocket of the present invention is not problematic as the design of the exterior pouch pocket, within which the concealed pocket is concealed, hides the bulky shape of the stored items.

U.S. Pat. No. 6,175,966 to Wiesenthal describes a concealed pocket located on the interior of a jacket for the purpose of concealing the backing of post-production embroidery on the interior side of the jacket. The concealed pocket is sealable via a zipper, and is only accessible by opening the jacket and gaining access to the interior of the jacket. The interior pocket is made from the same material as the exterior of the jacket and is sufficiently large as to cover the backing of the post-production embroidery on the jacket. One drawback to the Wiesenthal pocket is that an individual must open his or her jacket to gain access to the concealed interior pocket, exposing him or herself to the cold. The present invention is easily accessible from the exterior of the outer garment into which the concealed pocket is incorporated. An individual need not expose him or herself unnecessarily to the cold when accessing the pocket.

The present invention is an outer garment that incorporates a concealed pocket having a closure means that is locked inside of the pouch pocket of an outer garment—i.e., a hooded sweater or a fleece pullover featuring a pouch pocket. The purpose of the concealed pocket inside the pouch pocket is to allow an individual to more securely store his or her personal items while still retaining the pouch pocket for the purpose of providing a place to easily insert their hands. The design of the exterior pouch pocket allows for the easy concealment of bulky items such as keys or wallets within the concealed pocket, as the contour of the garment is covered by the exterior pocket and the pocket facilitates ease of entry and withdraw from the interior pocket.

It is therefore submitted that the present invention substantially diverges in design elements from the prior art and consequently it is clear that there is a need in the art for an improvement to existing outer garments devices to incorporate a concealed pocket within an exterior pouch pocket. In this regard the instant invention substantially fulfills these needs.

SUMMARY OF THE INVENTION

In view of the foregoing disadvantages inherent in the known types of concealed pockets in garments of clothing now present in the prior art, the present invention provides a new concealed pocket incorporated into the pouch pocket of an outer garment such as a hooded sweater or a pullover, wherein the same can be utilized for providing convenience for the user when he or she needs to store personal items within the pouch pocket and the individual does not wish for those items to accidentally fall out of the pocket or to be stolen from the pouch pocket.

It is therefore an object of the present invention to provide a new and improved outerwear garment that incorporates a concealed pocket within the pouch pocket of the garment having all of the advantages of the prior art and none of the disadvantages.

Another object of the present invention is to provide a concealed, interiorly-mounted pocket of simple construction within the pouch pocket of an outer garment, which an individual can easily access while providing securement of articles therein.

Another object of the present invention is to provide a closable concealed pocket capable of securely storing bulky personal items there within while retaining a free space in the pouch pocket such that an individual is able to place his or her hands therein.

Yet another object of the present invention is to provide a concealed pocket that is concealed by the pouch pocket of an outerwear garment such that any items stored in the concealed pocket would be relatively undetectable due to the outward appearance of the garment.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 4A:
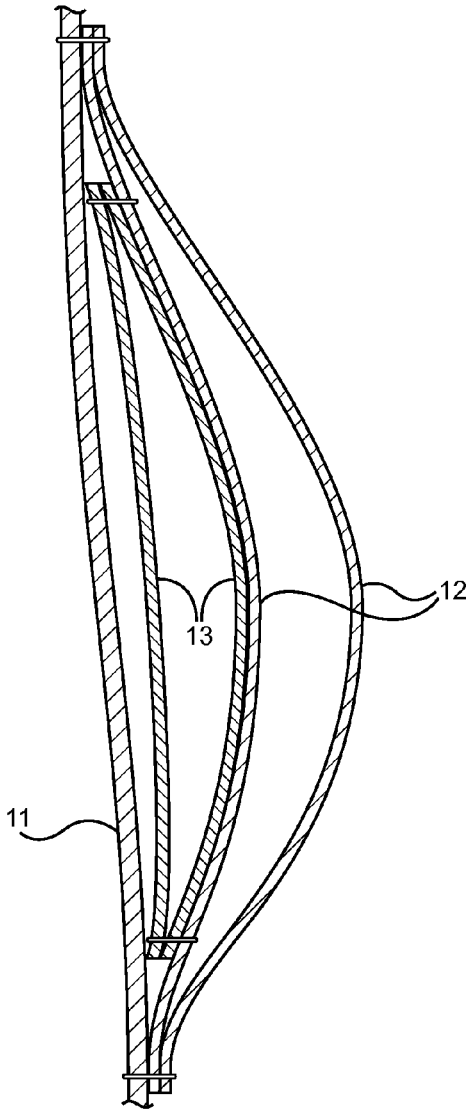
Figure 4B:
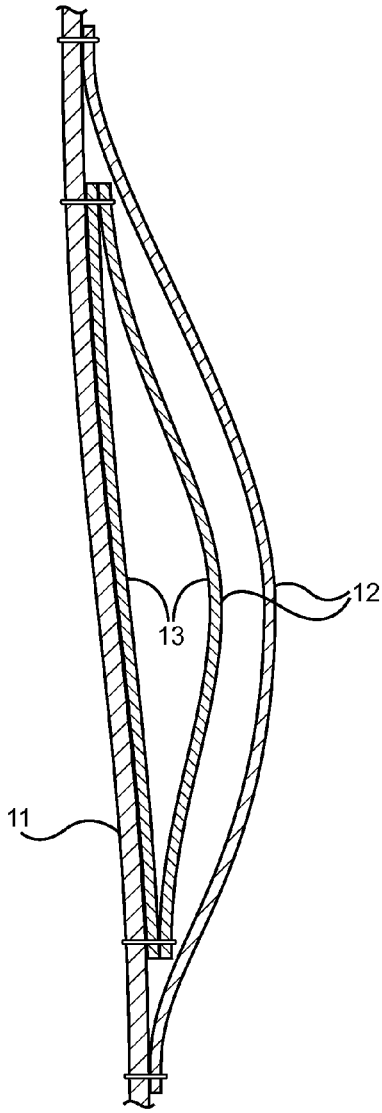

FIGS. 4A and 4B are cross-sectional views of the attachment of the interior pocket to the garment. In FIG. 4A, the interior pocket is attached to the inside surface of the exterior pocket. In FIG. 4B the interior pocket is secured to the front portion of the garment.

DETAILED DESCRIPTION OF THE INVENTION

Reference is made herein to the attached drawings. Like reference numerals are used throughout the drawings to depict like or similar elements of the outer garment with a concealed pocket concealed within the pouch pocket of the garment. For the purposes of presenting a brief and clear description of the present invention, the preferred embodiment will be discussed as incorporated into a hooded garment having a central pouch pocket. The figures are intended for representative purposes only and should not be considered to be limiting in any respect.

Figure 1:
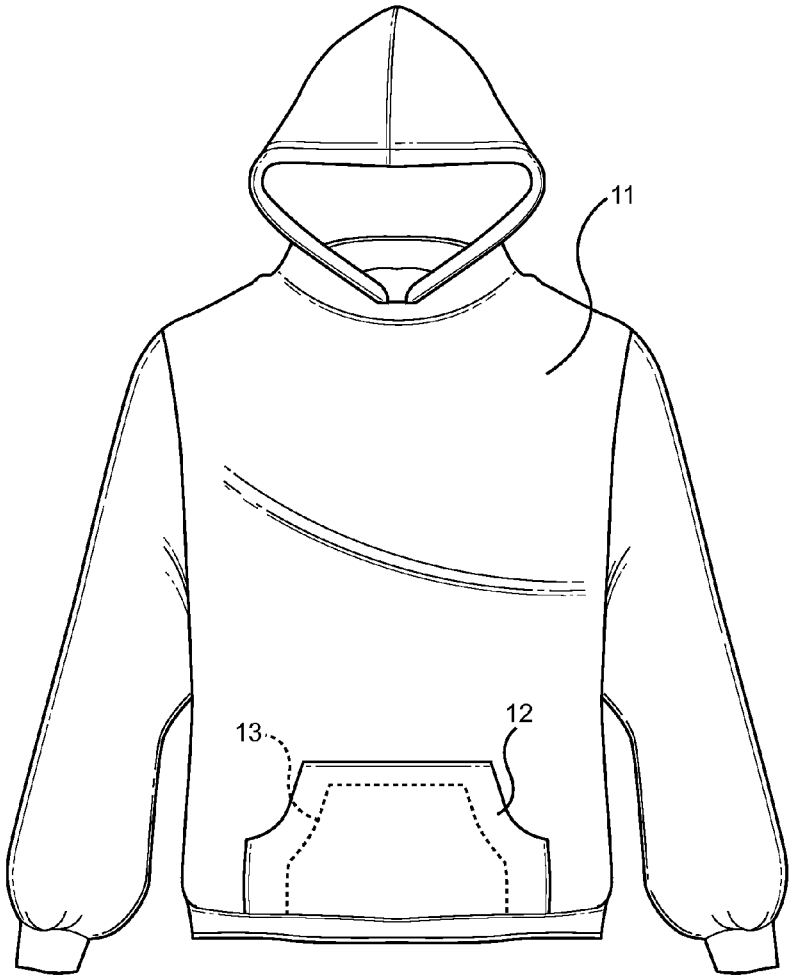
FIG. 1 is a frontal view of the outward appearance of the present invention utilized with a hooded garment. The concealed pocket is concealed within the pouch pocket of the hooded outer garment.

Referring now to FIG. 1, there is shown a frontal view of the outward appearance of an embodiment of the present invention. The outerwear garment in this embodiment of the present invention is a hooded sweatshirt 11 having a front and back side. Hooded sweatshirts 11 often have a central pouch pocket 12 located at the bottom of the garment front side. Within the pouch pocket 12 of the present invention is a concealed interior pocket 13. An individual can store a variety of personal items within the concealed pocket, including keys, wallets, cellular phones, money clips, sunglasses or other items. Any personal items that an individual contains within the concealed pocket inside the pouch pocket of the hooded sweatshirt are undetectable by the average onlooker since the pouch pocket has a masking effect over the concealed pocket, due to the overly large nature of hooded sweatshirts. The interior pocket's visual signature is eliminated, as the exterior view shows a standard hooded sweatshirt 11 having a central pouch pocket 12. The interior pocket 13 is a sealable compartment adapted to securely contain personal items and items of importance that are not desired to be left unsecured while traveling or otherwise engaging in an activity. The pouch pocket 12 provides for ease of entry and removal of larger items, but provides little in the way of securement of articles. The interior pocket 13 is adapted to provide a more secure compartment that is hidden under the outer pouch pocket 12.

Figure 2:
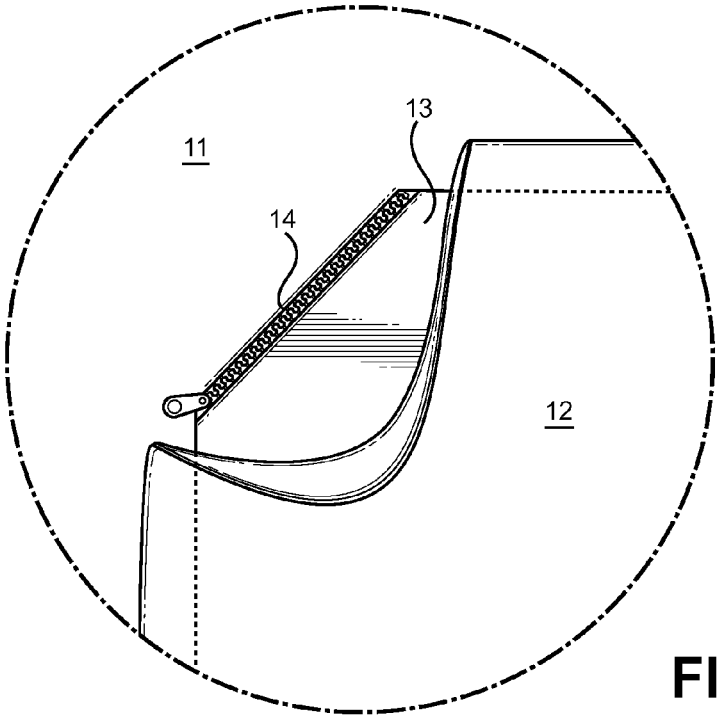
FIG. 2 is a close-up view of the present invention within the pouch pocket of an outer garment pulled back to reveal the concealed interior pocket inside.

Referring now to FIG. 2, there is shown a close-up view of the present invention with the pouch pocket 12 of the hooded sweater garment 11 pulled back to reveal the concealed interior pocket contained therewithin. The concealed pocket 13 is hidden within the pouch pocket 12 of the garment 11, allowing an individual to store his or her personal items inside, while still retaining the pouch pocket as a place to easily insert his or her hands. An individual can open or close the inner concealed pocket 13 of the present invention by manipulating the concealed pocket sealing mechanism 14. The concealed pocket sealing mechanism 14 can be, but is not limited to, a zipper, a set of snaps or hook and eye fasteners. The concealed pocket sealing mechanism is adapted to be any closure means that affects a secure closure of the interior pocket while not making access overly cumbersome. The sealing means serves two primary purposes: first, the sealing mechanism prevents items from accidentally falling out of the pocket, and secondly it protects the individual's personal items from theft by a pick-pocket, since a pick-pocket cannot easily manipulate the sealing mechanism to open the concealed pocket and reveal the personal items without being detected.

Figure 3:
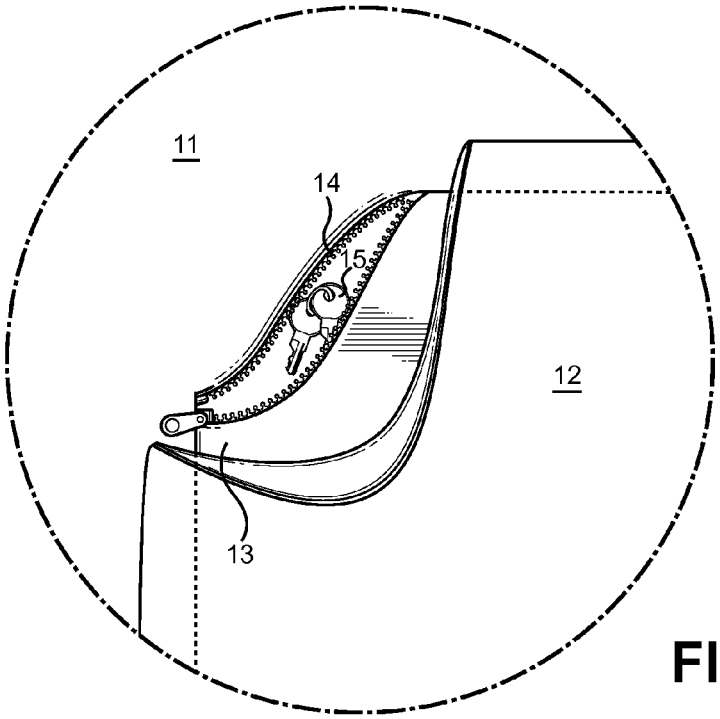
FIG. 3 is a close-up view of the present invention with the pouch pocket of the outer garment pulled back to reveal the concealed interior pocket inside. The concealed pocket is open to reveal the personal items contained within.

Referring now to FIG. 3, there is shown a perspective view of the present invention with the pouch pocket 12 of the outer garment 11 pulled back to reveal the concealed interior pocket 13 there within and a contemplated type of personal item 15 placed therein for securement. The sealing mechanism 14 of the concealed pocket 13 is open, thereby revealing a pair of keys contained within. The individual securely closes the concealed pocket and smoothes the pouch pocket against the fabric of the garment, thus concealing the pocket's presence and lowering its visual signature. The bulky design of outerwear garments, such as hooded sweaters, which incorporate pouch pockets, easily masks the concealed pocket and the shape of any personal items contained there within. Further, placement of the user's hands within the outer pouch pocket 12 provides additional concealment for larger items.

To use the present invention, an individual dons the outerwear garment with the pouch pocket located at the front such that the individual can easily place his or her hands inside the pouch pocket to manipulate the concealed pocket sealing mechanism. The individual pulls open the pouch pocket and opens the concealed pocket. After inserting his or her personal items inside the concealed pocket, the individual seals the concealed pocket. With his or her personal items inside the concealed pocket, the pouch pocket remains free for use by the individual as a place to insert his or her hands to keep warm. When the individual is ready to retrieve his or her personal items, he or she opens the sealed concealed pocket and removes the items.

The present invention is an outer garment that incorporates a closable concealed pocket that is sewn inside of the pouch pocket of an outer garment that features such a pouch pocket. The purpose of the concealed pocket inside the pouch pocket is to allow an individual to store his or her personal items in a secure location while still retaining the pouch pocket for the purpose of providing the individual with a place to easily insert their hands. The design of the exterior pouch pocket conceals bulky items, such as keys or wallets, stored within the concealed pocket from detection by an onlooker. It is contemplated that several outerwear constructions and designs may be utilized in connection with the disclosed interior pocket, including those of hooded, non-hooded and differing materials. It is desired to disclose a new and novel interior pocket that provides a means to concealably secure personal items in a garment with an otherwise open-air pocket that is less adapted to perform such a task on its own.

The construction of the interior pocket may take several different forms depending on the manufacturer or desired structure of the garment. The interior pocket may be sewn or otherwise incorporated into the interior surface of the pouch pocket as shown in FIG. 4A, wherein the interior pocket is capable of pulling away from the garment frontal surface in conjunction with the pouch pocket. Alternatively, and in a more desired embodiment, the interior pocket is sewn or otherwise incorporated into the garment front surface and covered by the pouch pocket as shown in FIG. 4B. Several variants with regard to structure are contemplated with regard to the present invention, falling within the scope and spirit of providing a concealed interior pocket.

It is therefore submitted that instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A concealed pocket for a garment, consisting of:

a hooded sweatshirt having a front and a back portion, said front and back portion having an interior and exterior surface;

a first section of material having a top, bottom, and side edges forming an exterior pocket, said exterior pocket having an interior and exterior surface and being attached to said front portion of said hooded sweatshirt exterior surface at said top and bottom edges and being open on said side edges;

a second section of material having a top, bottom, and side edges forming an interior pocket, said interior pocket being attached on at least two sides to said interior surface of said exterior pocket and being concealed between said hooded sweatshirt front portion exterior surface and said exterior pocket interior surface;

said interior pocket having at least one side opening allowing access to said interior pocket interior volume;

said interior pocket having a sealing means restricting access to said interior pocket interior volume, wherein said sealing means is positioned between said hooded sweatshirt front portion exterior surface and said exterior pocket.

2. The device of claim 1, wherein said interior pocket sealing means is a zipper.

3. A concealed pocket for a garment, consisting of:

a hooded sweatshirt having a front and a back portion, said front and back portion having an interior and exterior surface;

a first section of material having a top, bottom, and side edges forming an exterior pocket, said exterior pocket having an interior and exterior surface and being attached to said front portion of said hooded sweatshirt exterior surface at said top and bottom edges and being open on said side edges;

a second section of material having a top, bottom, and side edges forming an interior pocket, said interior pocket being attached on at least two sides to said exterior surface of sweatshirt front portion and being concealed between said hooded sweatshirt front portion exterior surface and said exterior pocket interior surface;

said interior pocket having at least one side opening allowing access to said interior pocket interior volume;

said interior pocket having a sealing means restricting access to said interior pocket interior volume, wherein said sealing means is positioned between said hooded sweatshirt front portion exterior surface and said exterior pocket.

4. The device of claim 3, wherein said interior pocket sealing means is a zipper.

* * * * *